US010253494B2

(12) United States Patent
Burke

(10) Patent No.: US 10,253,494 B2
(45) Date of Patent: Apr. 9, 2019

(54) WALL CONSTRUCTION

(71) Applicant: Designstone Pty Ltd, Mandurah (AU)

(72) Inventor: David Allan Burke, Halls Head (AU)

(73) Assignee: DesignStone Pty Ltd, Mandurah, WA (AU)

( * ) Notice: Subject to any disclaimer, the term of this patent is extended or adjusted under 35 U.S.C. 154(b) by 0 days.

(21) Appl. No.: 15/442,761

(22) Filed: Feb. 27, 2017

(65) Prior Publication Data

US 2017/0254069 A1 Sep. 7, 2017

(30) Foreign Application Priority Data

Mar. 2, 2016 (AU) ..... 2016900779

(51) Int. Cl.
*E04B 2/60* (2006.01)
*E04B 1/70* (2006.01)
*E04B 1/24* (2006.01)

(52) U.S. Cl.
CPC ..... *E04B 2/60* (2013.01); *E04B 1/7046* (2013.01); *E04B 2001/2478* (2013.01); *E04B 2001/2481* (2013.01)

(58) Field of Classification Search
CPC ..... E04F 13/141; E04B 2/60; E04B 1/642; E04B 1/625; E04B 2103/06
USPC ..... 52/58, 60, 61, 302.6
See application file for complete search history.

(56) References Cited

U.S. PATENT DOCUMENTS 2,245,965 A * 6/1941 Cunin ..... E04B 1/7046 52/204.2
5,979,123 A * 11/1999 Brockman ..... A01M 1/24 49/58
6,786,011 B2 * 9/2004 Mares ..... E04D 13/1415 52/302.6
6,964,136 B2 * 11/2005 Collins ..... E04B 1/70 52/204.2
7,603,816 B1 * 10/2009 Hohmann, Jr. ..... E04B 1/2604 43/132.1

FOREIGN PATENT DOCUMENTS

AU 641920 B 11/1990

* cited by examiner

*Primary Examiner* — Patrick J Maestri
(74) *Attorney, Agent, or Firm* — Hooker & Habib, P.C.

(57) ABSTRACT

A wall construction has a number of spaced upright channel-shaped studs and a number of concrete panels that form an exterior wall. The lower end of the studs are mounted on a concrete foundation member, and are provided with respective lower plates that enable moisture to drain away from the from the lower ends of the studs.

24 Claims, 6 Drawing Sheets

WALL CONSTRUCTION

RELATED APPLICATION

This application claims priority from co-pending Australian Provisional Patent Application No. 2016900779 "A Wall Construction" filed Mar. 2, 2016, with inventor David Allan Burke and applicant Designstone Pty Ltd, which priority application is incorporated by reference as if fully set forth herein.

FIELD OF THE DISCLOSURE

The disclosure relates generally to a wall construction for buildings.

BACKGROUND OF THE DISCLOSURE

Australian Patent Number 641920 incorporated by reference as if fully set forth herein discloses a wall construction shown in FIG. 6 that includes a number of spaced apart, uptight channel-shaped studs 118 and a number of concrete panels 126.

The studs 118 are supported on a concrete footing and slab 110 formed as a one piece unit in situ. The slab 110 is reinforced by mesh reinforcement 112 and has a peripheral recess 114 arranged to receive lower ends of the concrete panels 126.

Each concrete panel 126 includes a rear face having an outwardly projecting tie member 128 extending therefrom. The tie members 128 project into the channel-shaped studs 118 and engage horizontal pins or bars 130. The panels 126 are arranged to fit together in abutting relation and form an external wall of the completed wall structure.

An L-shaped (or alternatively an upwardly-facing U-shape) plate 116 extends along a side of the slab 110 adjacent the recess 114. The lower plate 116 is located below the studs 118 in the completed wall and faces upwardly so as to be able to receive lower ends of the vertical studs 118.

To secure the plate 116 to the studs 118 the lower end of each stud 118 has attached thereto a respective bracket 150. Each bracket 150 is generally J-shaped in side elevation and has an upwardly extending rear flange 151 and a lower flange 152. A lower bracket 150 is attached to the rear face of a stud 118 by bolts 153 passed through the flange 151. The lower flange 152 is integrally formed with the flange 151 and extends horizontally below the plate 116 as shown in FIG. 6 so as to engage the plate 116 with the stud 118.

Each bracket 150 has a hooked section 154 extending upwardly and inwardly from the end of the flange 152 remote from the flange 151 and being so shaped as to engage the plate 116 and enter the stud 118 being secured by the bracket 150.

The studs 118 are filled with concrete once the panels 126 have been mounted on the bars 130 and the bracket 50 has been bolted tightly in position. An interior wall 122 is mounted to inner faces of the studs 118 in known manner using horizontal channel members 124.

Although the wall construction shown in FIG. 6 has worked well, on occasion it has been found that the lower plate 116 has a tendency to accumulate moisture in use. The lower plate 116 is typically formed of ferrous metal such as steel. Thus, it has been found that the lower plate 116 is prone to corrosion.

SUMMARY OF THE DISCLOSURE

Disclosed is a wall construction that substantially eliminates the tendency of the wall to accumulate moisture in use, thereby reducing the incidence of corrosion in the wall construction.

An embodiment of the disclosed wall construction has a number of spaced upright channel-shaped studs and a number of concrete panels, the concrete panels having rear faces having at least one outwardly projecting tie member extending therefrom, the tie members extending into respective studs, wherein the studs each have a respective lower end, the lower ends of the studs being mounted on a concrete foundation member, and the lower ends of the studs being provided with respective lower plates having an intermediate section disposed below a stud and an inner upright section extending generally in engagement with an inner face of the stud and an outer downwardly extending section adjacent to an inner face of a concrete panel, such that moisture may drain away from the lower ends of the studs in use.

Other objects and features of the disclosure will become apparent as the description proceeds, especially when taken in conjunction with the accompanying drawing sheets illustrating one or more illustrative embodiments.

DETAILED DESCRIPTION

Figure 1:
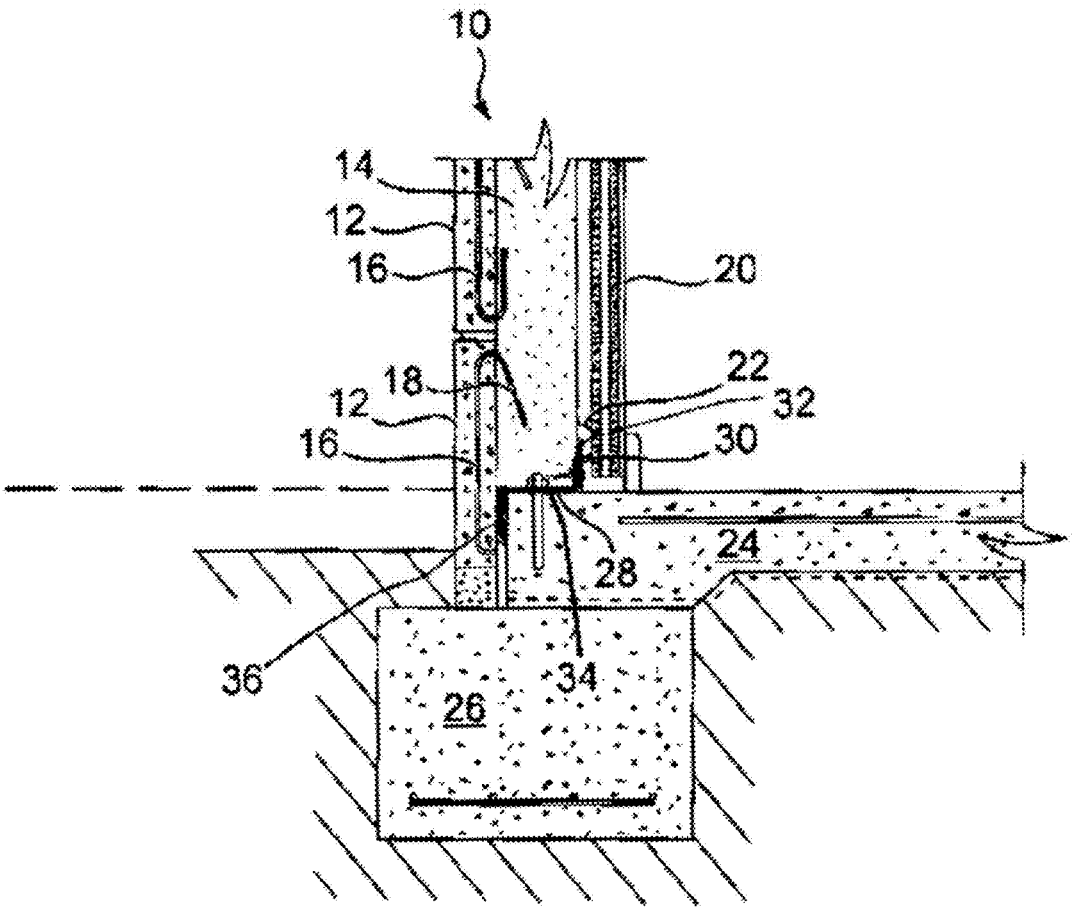
FIG. 1 is a schematic cross sectional view of a part of a wall construction in accordance with the present disclosure.
Figure 2:
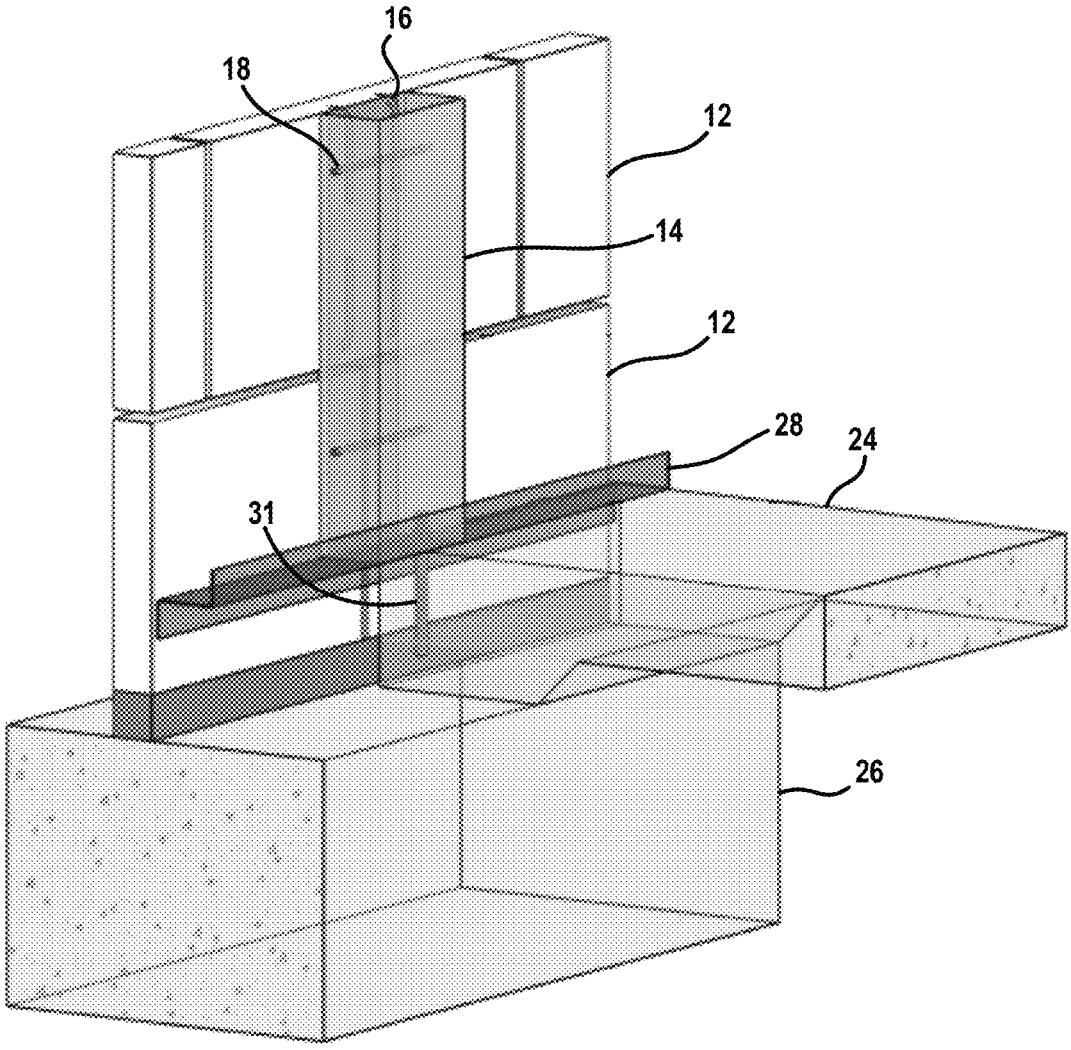
FIG. 2 is a schematic perspective view of the part of the wall construction shown in FIG. 1.

FIGS. 1 and 2 illustrate a wall construction 10 having a number of concrete panels 12 mounted on a number of channel-shaped steel studs 14. The studs 14 are spaced apart from one another along the length of the wall construction. Each panel 12 has a rearwardly and downwardly extending tie member 16. The tie members 16 are incorporated into the structure of the concrete panels 12 and extend outwardly and rearwardly into the studs 14. The studs 14 are oriented so that the channels thereof face the concrete panels.

Further, in the studs 14 the tie members 16 engage with respective pin members 18 each of which extends laterally across the channel of a respective stud 14. In use, the studs 14 are filled with concrete after the panels 12 and the tie members 16 are in place.

Still further, the construction 10 includes a furring channel 20 which is disposed inwardly of a stud 14. The furring channel 20 is spaced apart from the stud 14 by one or more generally U shaped brackets 22. The brackets 22 may be made of the same material as the furring channel. The brackets 22 are in contact with the furring channel on one side and are connected to the stud 14 by screws. A furring channel 20 may be attached to each stud 14.

The lower end 28 of each stud 14 is, as shown, mounted on a concrete foundation member 24. Further, the concrete foundation member 24 has an end mounted on a concrete footing member 26. The foundation member 24 and the footing member 26 can be a one-piece member like the footing member 110 or can be formed as individual members as shown in FIG. 1.

As shown, the lower ends 28 of the studs 14 are each mounted to a substantially Z shaped bottom plate 30. The illustrated plate 30 is a homogeneous, one=piece member made from plate that is galvanized to resist corrosion.

Each stud 14 is attached to the plate 30 by mechanical fasteners or by welding. The plate 30 in turn is mechanically or chemically attached to an upper surface of the foundation member 24. The illustrated plate 30 is attached to the foundation member 24 by mechanical fasteners, namely masonry fasteners 31. The exposed ends of the fasteners 31 are disposed at least partially within the studs 14. In other embodiments the plate 30 is attached to the foundation member using chemical adhesives that fasten the members together by chemical bonds.

The bottom plate 30 includes an upright section or portion 32 which extends upwardly along an adjacent inner side of the stud 14, a central section or portion 34 which extends beneath the stud 14 and a lateral section or portion 36 remote from the portion 32 which extends downwardly in contact with the foundation member 24. The illustrated plate portions 32, 34, 36 are each flat and generally planar.

In use, it has been found that water may accumulate adjacent the lower end 28 of a stud 14. With the use of the bottom plate 30 as described herein there is a drainage channel along the bottom plate 30 from the upright portion 32, along the central portion 34 and then down the lateral section portion 36 to the footing member 26. Further, the lateral section portion 36 resists water from freely passing inward along the junction between the lower plate 30 and the lower stud end 28. This avoids a build-up of water at the lower end 28 of the stud, thus reducing the incidence of corrosion at this part of the wall construction.

In other possible embodiments, the one-piece bottom plate 30 is replaced by separate individual lower plates 30, the lower end of each stud being attached to a respective lower plate. Each individual lower plate has the same cross section as the plate 30 to avoid buildup of water. Each lower plate can be mechanically or chemically attached to the foundation member 24.

Figure 3:
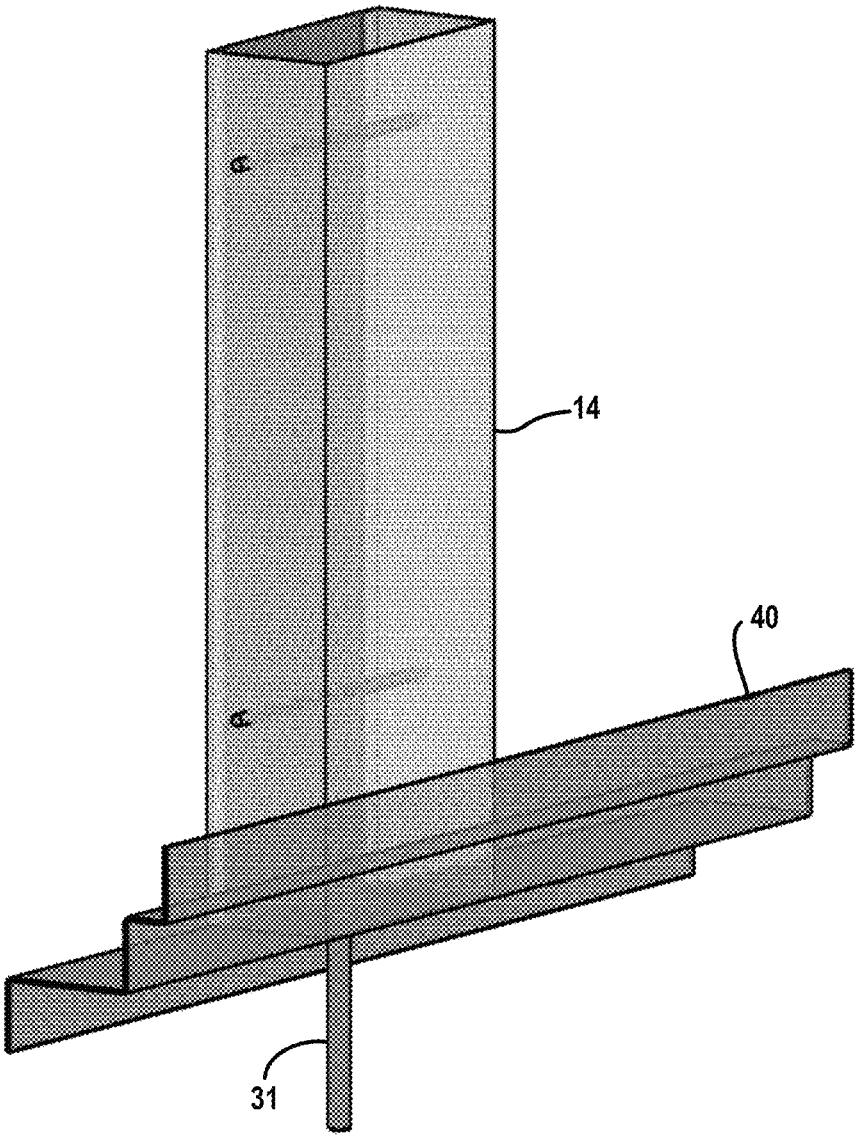
FIG. 3 is similar to FIG. 2 but illustrates part of a second embodiment wall construction.
Figure 4:
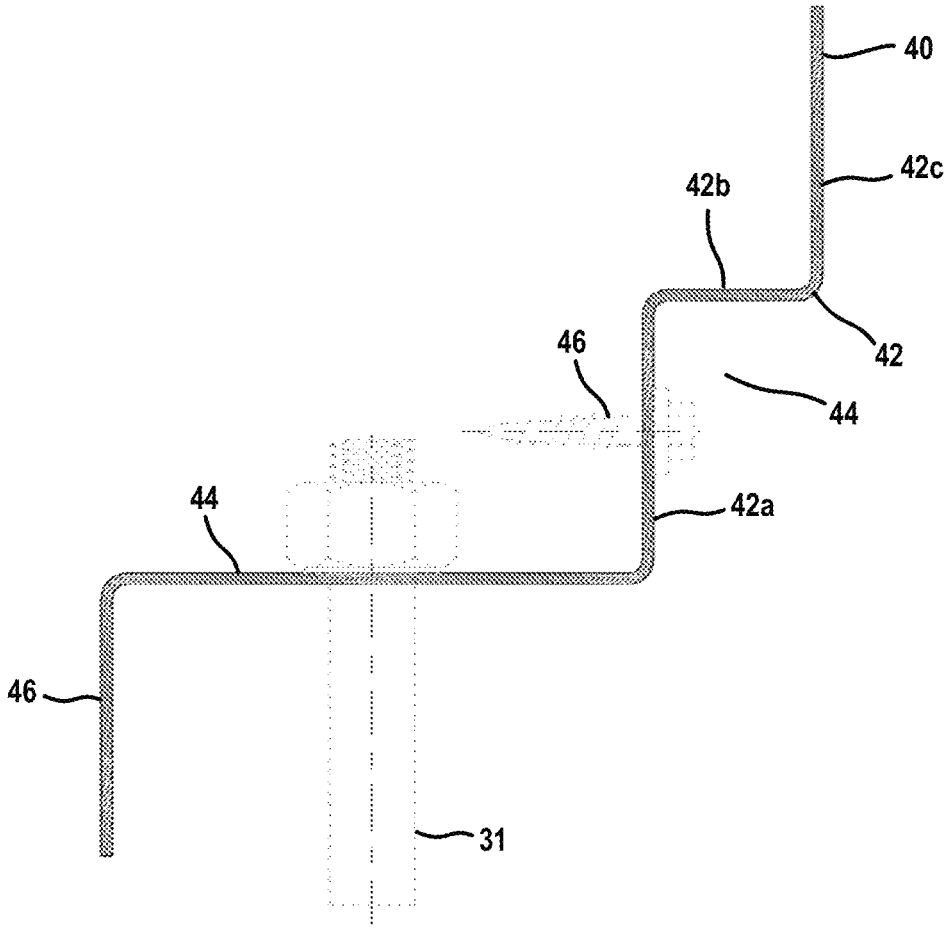
FIG. 4 is a sectional view of the lower plate used in the wall construction shown in FIG. 3.

FIGS. 3 and 4 illustrate a second embodiment wall construction that utilizes a bottom plate 40 that is different from the bottom plate 30. Only the differences between the plate 30 and the plate 40 will be discussed. The plate 40 includes an upright section or portion 42, a central section or portion 44 which extends beneath the studs 14, and a lateral section or portion 46 similar to the lateral portion 36 of the plate 30.

The upright portion 42 is itself a Z shaped portion and includes a lower upright portion 42*a*, an intermediate central portion 42*b*, and an upper upright portion 42*c*. The lower upright portion 42*a* extends upwardly away from one side of the body central portion 44 and extends upwardly along adjacent inner sides of the studs 14. The central intermediate portion 42*b* extends from the upper end of the lower upright portion 42*a* away from the studs 14 and is substantially perpendicular to the stud vertical axes. The upper upright portion 42*c* extends from a side of the intermediate portion 42*b* away from the lower upright portion 42*a* and extends generally parallel with the lower upright portion 42*a*.

The lower upright portion 42*a* and the intermediate central portion 42*b* define a pocket or recess 44 adjacent to the lower ends of the studs 14 that enables threaded fasteners 46 to extend from the recess 44, through the upright portions 42*a*, and into the studs 14 for attaching the studs to the lower plate 40. The exposed heads of the fasteners 46 are disposed in the recess 44 as shown in FIG. 4.

Figure 5:
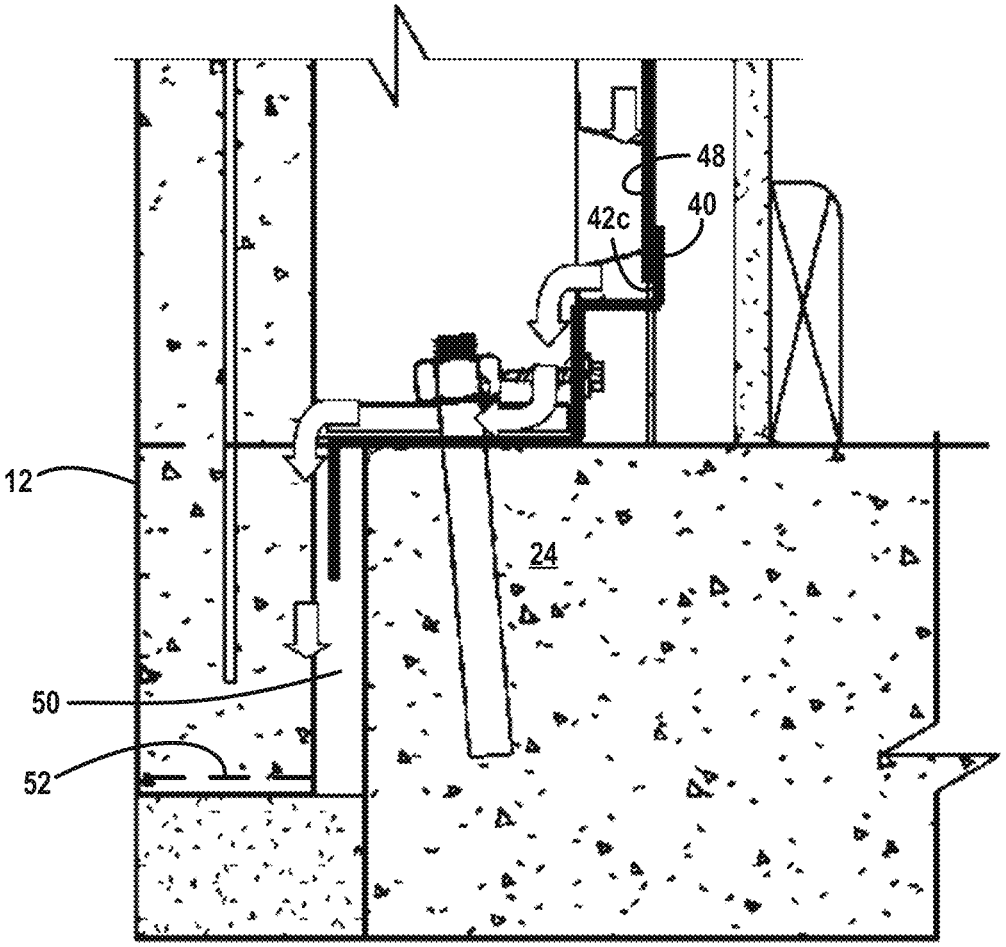
FIG. 5 is a sectional view similar to that of FIG. 2 and illustrates water draining from the wall construction shown in FIG. 3.
Figure 6:
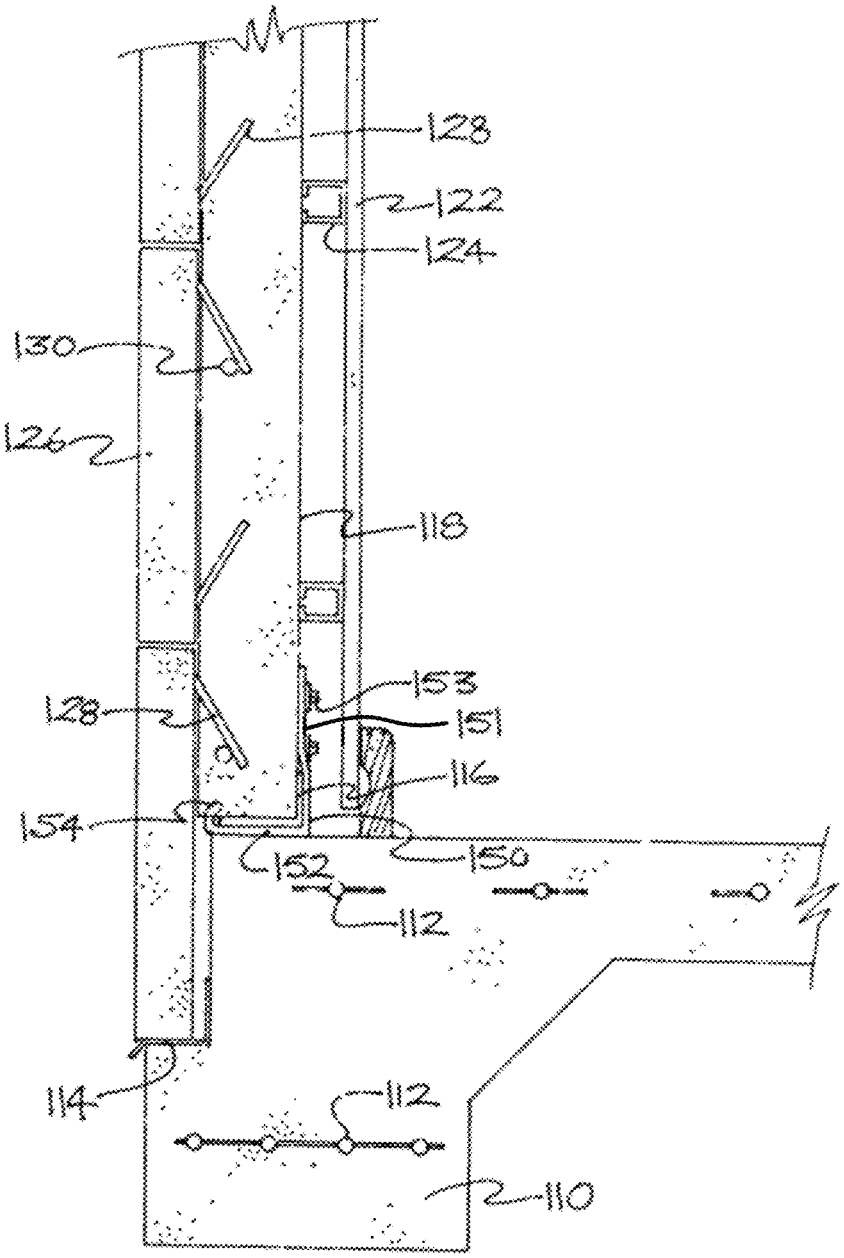
FIG. 6 PRIOR ART
FIG. 6 is a schematic cross sectional view of a part of a prior art wall construction.

FIG. 5 illustrates water (represented by the arrows in the drawing) draining from the lower plate 40 in a manner similar to that described for the lower plate 30. The water may be condensate that forms between the studs 14 and a conventional waterproof barrier 48 spaced from and facing the inner faces of the studs. The lower end of the barrier 48 extends to the lower plate 40 and is against the inner side of the upright portion 42*c* to be between the lower plate 40 and the studs.

Water flows down the barrier 48 to the lower plate 40, flows across the plate intermediate portion 42*b*, and then down the lower upright portion 42*a*. The lower upright portion 42*a* is located in a gap 50 between the panels 12 and the foundation member 24. The gap 50 receives the water from the lower plate 40. The lower-most panels 12 include weep holes 52 near the lower ends of the panels that fluidly communicate the gap 42 to the outside of the wall for drainage of the water from the wall construction 10. The illustrated weep holes 52 are quarter-inch diameter through holes spaced apart from one another about six feet (about two meters) along the wall.

The one-piece lower plate 40 may in other embodiments of the wall construction be replaced by individual lower plates 40 that each attach to a respective stud 14.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges (temperature, volume, displacement, stroke length, concentration, and the like), environment of use, and also such changes and alterations as fall within the purview of the following claims.

What is claimed is:

1. A wall construction comprising:

a plurality of spaced apart, upright channel-shaped studs and a plurality of panels, the panels having rear faces having at least one outwardly projecting tie member extending therefrom, the tie members of the panels extending into the studs, the studs each have a respective lower end, an outer face facing the panels and an opposite inner face facing away from the panels, the lower ends of the studs being mounted on an upwardly facing surface of a foundation member that faces the plurality of studs, and the lower ends of the studs being provided with respective lower plates, each lower plate being rigidly fastened to the foundation member and having an intermediate section disposed below the stud, an inner upright section extending generally in engagement with the inner face of the stud, and an outer downwardly extending section facing the rear face of at least one of the panels;

the intermediate section of each lower plate having an upper surface engaging the stud and an opposite lower surface engaging the foundation member, the outer section of each lower plate extending downwardly away from the intermediate section, the outer section extending below the upper surface of the foundation member along the foundation member, the outer section having an inner surface facing the foundation member and an opposite outer surface facing an air gap being disposed between the outer surface and the said rear face of one or more of the panels, the air gaps extending downwardly along the foundation member wherein moisture from the lower ends of the studs may drain off the intermediate sections of the lower plates by flowing over the lower sections of the lower plates and through the air gaps.

2. The wall construction of claim 1 wherein the lower plates are each a respective portion of a one-piece member.

3. The wall construction of claim 2 wherein the one-piece member has a "Z" shaped cross section.

4. The wall construction of claim 3 wherein the one piece member includes an inner section that includes the inner sections of the lower plates, an intermediate section that includes the intermediate sections of the lower plates, and an outer section that includes the outer sections of the lower plates; and the intermediate section of the one-piece member is transverse to the inner and outer sections of the one piece member.

5. The wall construction of claim 2 wherein the lower end of each stud is mechanically attached or welded to the one-piece member.

6. The wall construction of claim wherein each lower plate is mechanically fastened to the foundation member by a screw disposed in the channel defined by the wall stud and extending through the lower plate and into the foundation member.

7. The wall construction of claim 1 wherein the lower plates are respective members spaced apart from one another, each stud attached to a respective one lower plate, each lower plate having a "Z" shaped cross section.

8. The wall construction of claim 1 wherein the one or more panels having rear faces that face the air gaps comprise weep holes that fluidly communicate with the air gaps.

9. The wall construction of claim 7 wherein each lower plate is mechanically fastened or chemically fastened to the foundation member.

10. The wall construction of claim 7 wherein the lower end of each stud is mechanically fastened or welded to the respective one lower plate.

11. The wall construction of claim 1 wherein each panel is a concrete panel.

12. The wall construction of claim 1 wherein the foundation member is a concrete foundation member.

13. The wall construction of claim 1 wherein the inner upright section comprises a first section portion in engagement with the inner face of the stud and a second section portion spaced away from the inner face of the stud.

14. The wall construction of claim 13 wherein the inner upright section comprises an intermediate section portion disposed between the first and second section portions.

15. The wall construction of claim 14 wherein the intermediate section portion and the first section portion bound a pocket adjacent to the lower end of the stud.

16. The wall construction of claim 1 comprising a waterproof barrier facing the inner faces of the studs and disposed between the studs and the inner upright sections of the lower plates.

17. The wall construction of claim 16 wherein the panels include lower-most panels, the lower-most panels and the foundation member defining a gap therebetween, the outer downwardly extending sections of the lower plates being disposed in the gap.

18. The wall construction of claim 17 wherein the lower-most panels comprise weep holes opening into the gap.

19. The wall construction of claim 1 wherein the panels include lower-most panels, the outer downwardly extending sections of the lower plates are disposed in a gap between the foundation member and the lower-most panels, and the lower-most panels comprise one or more weep holes opening into the gap.

20. The wall construction of claim 14 wherein each of the first section portion, the second section portion, and the intermediate section portion are generally planar portions, and the intermediate section portion is transverse to the first and second section portions.

21. The wall construction of claim 13 wherein each inner upright section is Z shaped.

22. The wall construction of claim 8 wherein the weep holes are disposed below the lower plates.

23. The wall construction of claim 1 wherein each of the lower plates is made of metal.

24. The wall construction of claim 1 wherein the air gaps extend downwardly beyond the lower plates.

* * * * *